United States Patent [19]

Dunn, Jr.

[11] 4,390,400

[45] Jun. 28, 1983

[54] ALUMINUM CHLORIDE ADDITION TO ELECTROLYTIC CELLS

[75] Inventor: Wendell E. Dunn, Jr., Spearfish Canyon, S. Dak.

[73] Assignee: Reynolds Metals Company, Richmond, Va.

[21] Appl. No.: 266,951

[22] Filed: May 26, 1981

[51] Int. Cl.[3] ..... C25C 3/06; C25C 3/18

[52] U.S. Cl. ..... 204/67; 423/495

[58] Field of Search ..... 204/67; 423/495

[56] References Cited

U.S. PATENT DOCUMENTS 4,108,968 8/1978 Jacobs et al. ..... 204/67

4,301,138 11/1981 Ryan et al. ..... 423/495

OTHER PUBLICATIONS

Sharma et al, Trans. Instn. Mining Metallurgy, Section C, vol. 85 (Jun. 1976) pp. C109 & C110.

*Primary Examiner*—Howard S. Williams

*Attorney, Agent, or Firm*—Alan T. McDonald

[57] ABSTRACT

The problem of transferring a highly hygroscopic, subliming solid, aluminum chloride, from a condensation zone at the end of a chlorination process to a reduction cell is solved by condensing the aluminum chloride values not as a solid, but as a low melting point liquid complex with depleted reduction cell salt melt. The complex may be transferred to the reduction cell either as a liquid or it may be solidified for storage, subsequently rendered particulate and delivered to the reduction cell as a solid.

3 Claims, No Drawings

ALUMINUM CHLORIDE ADDITION TO ELECTROLYTIC CELLS

FIELD OF THE INVENTION

This invention relates to the production of aluminum chloride suitable for reduction to aluminum metal reduction and more particularly to the process of adding aluminum chloride to an aluminum reduction cell.

BACKGROUND OF THE INVENTION

Condensation of aluminum chloride, a subliming solid, has been difficult. A number of publications describing aluminum chloride condensed in particular ways to form a bulk aluminum chloride that can be added as a solid to a reduction cell have been published. However, in spite of this there are more recent proposals describing specific methods for handling the problem of feeding aluminum chloride to an aluminum reduction cell.

The high temperature of the cell and the high surface area of aluminum chloride, which is extremely hygroscopic, make it imperative that an effective cell addition method be devised, since the introduction of a hydrated aluminum chloride even in small amounts is considered undesirable in aluminum chloride cell operation.

OBJECTS OF THE INVENTION

It is an object of this invention to allow ease in the handling of aluminum chloride values, particularly in storage and transfer into an aluminum chloride cell. It is also an object to this invention to reduce the absorption of impurities, particularly water, by the aluminum chloride in handling and storage. It is a further object of the invention to improve the storage efficiency and to improve the process of addition to the aluminum reduction cell.

SUMMARY OF THE INVENTION

This invention recognizes the inherently difficult handling problem posed by the condensation from a chlorination stream of a highly hygroscopic subliming solid and recognizes the difficulty of condensing aluminum chloride as a high bulk density solid. The invention consists of a condensation of the aluminum chloride values, not as a solid, but as a liquid complex with spent reduction cell salt melt, which complex has a low melting point, followed by solidification either before or after storage in an easily handled bulk form such as a chipped or cast solid.

In order to accomplish this, the process of transferring aluminum chloride values to the cell salt melt is translocated from the reduction cell's surface to the point of aluminum chloride condensation. Thus the step of condensation and the step of absorption into the depleted cell melt are performed simultaneously, not at the cell but in the condensation stage. Following this, the low melting liquid complex which now has a high aluminum chloride concentration and high density with negligible surface area can be cooled and cast or chipped for later transfer to the cell or can be stored as a liquid for addition to the cell at a later time.

DETAILED DESCRIPTION

This invention may be practiced in any of several convenient ways. The condensation may occur over a packed bed of inert ceramic giving extended surface for the chemical reaction of the gaseous aluminum chloride dimer and the alkali chloride melt which comprises the depleted reduction cell melt.

Another means of practicing the invention is the contact of the gas with solidified cell melt which has been cast or chipped after removal by overflow from the cell. The overflow can be accomplished by the introduction of fresh, enriched cell melt comprised of the alkali aluminum chloride salt complex with a large dissolved component of aluminum chloride.

The addition to the cell may be either as a liquid complex pumped from a storage area or the solidified enriched cell melt added as a solid to the cell.

The aluminum alkali complex will have a melting point of 150° C. or less depending upon the composition of the cell bath with respect to alkali chloride components. This allows easy handling of the liquid and yet allows reasonable heat transfer in a cast or chipping operation. The bulk density of the solidified enriched cell melt will vary from 60 to over 120 pounds per cubic foot which will allow easy storage of the aluminum values.

It is noted that in the operation of an aluminum chloride reduction cell the chlorine values must be recycled to an operating chlorinator. Since the above mentioned complex is very conveniently stored, the inclusion of a complex melt storage stage provides flexibility which permits coupling of a chlorinator with a bank of reduction cells. There is an inherent operating stream factor difference between a multi-unit cell bank and a single or double chlorinator line, the multi-unit bank operating very steadily, the chlorinators having to undergo significant down time for maintenance operations, etc. The cell reduction stream factor might be as much as 25% greater than the chlorinator stream factor, hence a flexible aluminum chloride storage system is of significant advantage. Chlorine inventory need not be stored as chlorine but may be stored as aluminum chloride complexed with the alkali chloride of the spent cell mixture.

I claim:

1. A method for transferring aluminum chloride values from a condensation zone to an electrolytic cell for the reduction of aluminum chloride comprising the steps of:
   (a) condensing gaseous aluminum chloride dimer in contact with solid depleted reduction cell melt comprising an alkali chloride to form a liquid aluminum chloride/alkali chloride complex; and
   (b) transferring the liquid aluminum chloride/alkali chloride complex to the electrolytic reduction cell.

2. A method for transferring aluminum chloride values from a condensation zone to an electrolytic cell for the reduction of aluminum chloride comprising the steps of:
   (a) condensing gaseous aluminum chloride dimer in contact with solid depleted reduction cell melt comprising an alkali chloride to form a liquid aluminum chloride/alkali chloride complex having a melting point below about 150° C.;
   (b) solidifying the liquid complex of (a) to a solid having a bulk density of between about 60 and 120 pounds per cubic foot; and
   (c) transferring the solid complex to the electrolytic reduction cell.

3. The method of claim 2 wherein the condensation of step (a) is performed over a packed bed of inert ceramic.

* * * * *